US011168546B2

(12) United States Patent
Melhus et al.

(10) Patent No.: US 11,168,546 B2
(45) Date of Patent: Nov. 9, 2021

(54) GUN FOR ORIENTED PERFORATION

(71) Applicant: TCO AS, Indre Arna (NO)

(72) Inventors: Geir Arne Melhus, Bryne (NO); Jostein Elbert, Kjøpmannskjær (NO); Oliver Guest, Sola (NO)

(73) Assignee: TCO AS, Bergen (NO)

( * ) Notice: Subject to any disclaimer, the term of this patent is extended or adjusted under 35 U.S.C. 154(b) by 0 days.

(21) Appl. No.: 16/627,866

(22) PCT Filed: Jul. 4, 2018

(86) PCT No.: PCT/NO2018/050177

§ 371 (c)(1),
(2) Date: Dec. 31, 2019

(87) PCT Pub. No.: WO2019/009735

PCT Pub. Date: Jan. 10, 2019

(65) Prior Publication Data

US 2020/0157924 A1 May 21, 2020

(30) Foreign Application Priority Data

Jul. 5, 2017 (NO) ..... 20171107

(51) Int. Cl.

| | |
|---|---|
| ***E21B 43/117*** | (2006.01) |
| ***E21B 43/116*** | (2006.01) |
| ***E21B 43/119*** | (2006.01) |

(52) U.S. Cl.

CPC ..... *E21B 43/116* (2013.01); *E21B 43/117* (2013.01); *E21B 43/119* (2013.01)

(58) Field of Classification Search

CPC .... E21B 43/116; E21B 43/119; E21B 43/117; E21B 43/11

See application file for complete search history.

(56) References Cited

U.S. PATENT DOCUMENTS

| | | | | |
|---|---|---|---|---|
| 4,598,775 | A | 7/1986 | Vann et al. | |
| 5,775,426 | A | 7/1998 | Snider et al. | |
| 6,595,290 | B2 * | 7/2003 | George | E21B 43/119 166/297 |

(Continued)

FOREIGN PATENT DOCUMENTS

WO 2015006869 A1 1/2015

OTHER PUBLICATIONS

Patent Cooperation Treaty, PCT, Written Opinion of the International Preliminary Examining Authority (PCT Rule 66), dated Jul. 24, 2019, PCT/NO2018/050177, Applicant TCO AS, Authorized Officer: Jucker Chava.

(Continued)

*Primary Examiner* — Yong-Suk (Philip) Ro

(74) *Attorney, Agent, or Firm* — Flener IP & Business Law; Zareefa B. Flener

(57) ABSTRACT

A gun for perforating a casing, liner or tubing of a well comprising multiple perforating charges in a mounting fixture configured to rotate inside a gun carrier and orientate the charges to a predetermined direction relative to the casing, liner or tubing. The mounting fixture and the charges are carried by an orienting tube, and the orienting tube is rotatably supported inside the gun carrier, thereby creating a rotatable assembly for orienting the charges into a predetermined direction.

20 Claims, 8 Drawing Sheets

(56) References Cited

U.S. PATENT DOCUMENTS

Figure 1A:
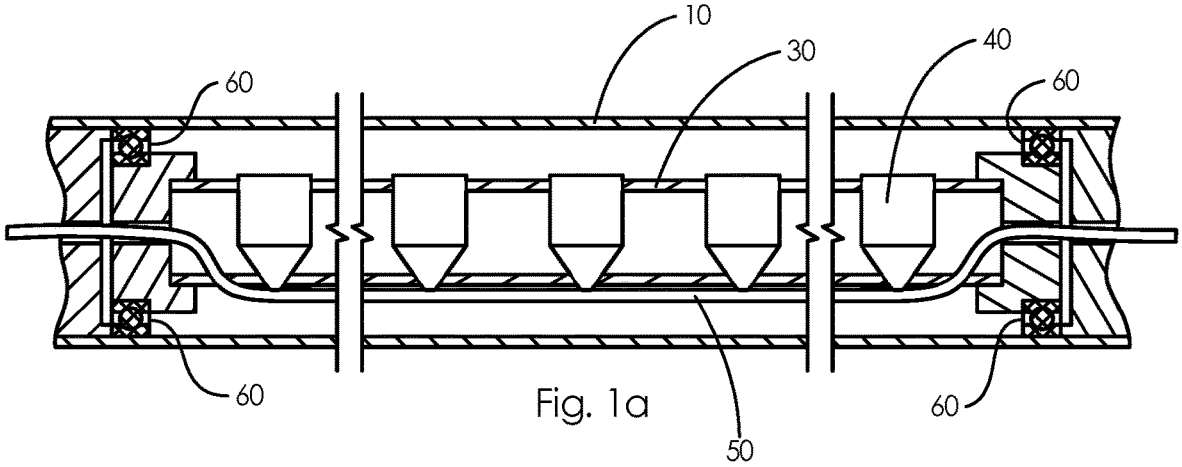

| | | | |
|---|---|---|---|
| 8,807,206 | B2 | 8/2014 | Walker |
| 2002/0185275 | A1 | 12/2002 | Yang et al. |
| 2003/0098158 | A1 | 5/2003 | George et al. |
| 2005/0115441 | A1 | 6/2005 | Mauldin et al. |
| 2007/0107589 | A1 | 5/2007 | Rospek et al. |
| 2011/0094744 | A1 | 4/2011 | Hales et al. |
| 2012/0168162 | A1 | 7/2012 | Sampson et al. |
| 2014/0144702 | A1 | 5/2014 | Walker |

OTHER PUBLICATIONS

Patent Cooperation Treaty, PCT Written Opinion of the International Searching Authority (PCT Rule 43BIS.1), dated Feb. 10, 2018, PCT/NO2018/050177, Applicant: TCO AS, Authorized Officer: Bjorn Lindkvist.

Patent Cooperation Treaty, PCT, International Search Report (PCT Article 18 And Rules 43 AND 44), PCT/NO2018/050177, Applicant: TCO AS, International Filing Date: Apr. 7, 2018, Form PCT/ISA/210 (dated Jan. 2015).

Patent Cooperation Treaty, PCT, Written Opinion of the International Preliminary Examining Authority (PCT Rule 66), dated Apr. 10, 2019, PCT/NO2018/050177, Application TCO AS, Authorized Officer: Jucker, Chava.

* cited by examiner

GUN FOR ORIENTED PERFORATION

FIELD OF THE INVENTION

A gun for perforating a casing, liner or tubing of a well comprising multiple perforating charges in a mounting fixture configured to rotate inside a gun carrier and orientate the charges to a predetermined direction relative to the casing, liner or tubing.

BACKGROUND OF THE INVENTION

Well perforation is performed to provide flow communication between a cased wellbore and a reservoir. Perforation is performed by sending a tool string with one or more perforating guns downhole until the gun(s) reaches the desired location(s) for perforation. The perforating guns create perforations through the casing and cement and into the formation by use of explosive charges. When perforating a well, it is often beneficial to perforate in a specific direction or a specific range of directions relative to the borehole. There are several reasons for why oriented perforating is desirable, amongst others; avoid sand influx, prevent damage to downhole equipment, and enhance well productivity. Such factors are based on a complete understanding of the reservoir formation and the fluid in the formation. Achieving accurate and reliable orientation of the perforating charges therefore becomes important. For an orienting gun, the charges are typically all arranged to shoot in one specific direction, often upwards, or in a zig-zag pattern alternating around a single direction, for example so that every other charge shoots +10° relative to vertical and the other charges shoot −10° relative to vertical. The charges are placed in a fixture, typically a loading tube, which seats multiple charges in a row along the guns longitudinal axis, and this loading tube is placed inside a gun carrier. A detonating cord is laid along the inside of the gun carrier or the loading tube, in contact with the primer explosive on each charge, and when ignited, the charges fire almost instantaneously and shoots a jet out through the gun carrier, the liner of the bore hole, the cement surrounding the liner, and some distance into the formation, to create an open path to the formation where the oil can run through.

When perforating, the resulting debris can cause obstruction and contamination issues, and hence it is desirable that the amount of debris exiting the gun is reduced to a minimum. The main concern is damage to completion equipment. Debris in borehole may cause damage to completion equipment such as plugs, packers and polished bore interfaces. For example, setting packers in fluid with debris may cause leakage, and interfacing with a polished bore when debris is present will result in leakage and damage to the bore. In addition, debris entering production fluid is not desirable. To achieve a successful perforation maximising the productivity of the well, the perforation is delivered exactly at the desired location in the wellbore, with correct orientation and pattern of the perforations, and with a minimum of gun debris.

When using the term "perforating gun" in this document, the term refers to either a single gun or a string of guns arranged in series, as the elements of relevance described in the present invention are not dependent on whether the system comprises one or more guns in series.

Some of the existing methods for perforating a well in a predetermined direction rely on rotation of the gun carrier inside the casing of the bore hole. Contact friction between the gun carrier and casing and debris in borehole may result in inaccurate and unreliable orientation.

Other methods use a mounting fixture, typically called a loading tube, rotatably supported inside the gun carrier at the ends. A typical loading tube has a circular or near circular cross section, and it has holes or openings in the wall for mounting and holding in place the charges, causing a significant reduction in stiffness of the tube. Due to the weight of the charges and the loading tube itself, the loading tube can begin to sag. As a result, this may cause the loading tube or the charges to rest on the inside of the gun carrier creating a friction great enough to prevent correct orientation of the charges. This limits the length of the loading tube and thereby the length of the area to be perforated by a gun. U.S. Pat. No. 6,595,290 presents a perforating gun for oriented perforation downhole where multiple rotational supports are used along the loading tube to avoid sagging and prevent the charges or the loading tube from contacting the interior of the gun carrier which would restrict rotation of the loading tube. The charges are either mounted in multiple loading tubes with rotational supports in between each tube and at each end of the gun, or they are mounted in one single loading tube extending through the entire length of the gun carrier having rotational supports periodically along the length of the loading tube. The rotational supports include rolling elements or bearings contacting the inside of the gun carrier.

Perforating guns also offer independent rotation of various lengths of gun sections in a series, for example by use of external swivel gun connectors and external weight biasing.

SUMMARY OF THE INVENTION

The present invention is based on rotating the charges inside the gun carrier in order to achieve correct orientation of the charges relative to borehole. It is further based on adding stiffness to the rotating assembly containing the charges in order to minimize deflection or sagging of the rotating assembly between two supports due to self weight and objects carried, for example the weight of the charges.

It is an object of the invention to provide a tool for perforating a well. The perforation includes creating holes in the casing, liner or tubing of the well in order to achieve fluid communication between the reservoir and the wellbore. Furthermore, it is an object to provide a device for perforating the well in a specific direction or in specific directions.

Moreover, it is an object to enable orientation of the charges in specific direction(s) after the perforating gun has been inserted and placed in the desired location in the borehole so as to perforate in a predetermined direction.

It is also an object of the present invention to provide a solution for accurately orienting the charges of a perforating gun by allowing the charges to be rotated inside the gun carrier into a predetermined position.

It is an object of the present invention to provide a solution that eliminates, or substantially reduces the risk of causing damage to tools to be used in the well upon a completed perforation of the casing, liner or tubing in the well, in particular the surface facing or forming an interface with tools used, such as for example plugs, packers, polished bore interfaces, valves, etc.

Another object is to reduce limitations to the length of the perforating section caused by deflection of the fixture holding the charges. Yet another object is to allow deflection of the fixture holding the charges without coming into conflict with the inside of the gun carrier during orientation of the charges inside the wellbore.

Moreover, it is an object to reduce deflection or sagging of the rotatable assembly that orients the charges, thereby avoiding contact between the rotatable assembly, or elements rotating together with this assembly, such as the charges, and the inside of the gun carrier, without the need for multiple intermediate rotating support structures. By eliminating the need for multiple intermediate rotating support structures, the assembly becomes less complex to manufacture and assemble and hence less expensive, has a lower risk of malfunction, and the need for replacing or repairing parts is reduced.

Yet an additional objective of the present invention is to reduce the amount of debris exiting the perforations of the gun.

A still further object of the invention is to provide a solution eliminating, or at least substantially reducing possible unintentional leaks in the completed well.

The objects of the invention are achieved by a perforating gun as defined by the independent claim, while alternatives, variants and embodiments are defined by the dependent claims.

According to the invention, a gun for perforating a casing, liner or tubing of a well is achieved, comprising multiple perforating charges in a mounting fixture configured to rotate inside a gun carrier and orientate the charges to a predetermined direction relative to the wellbore and hence the casing, liner or tubing. The perforating gun also comprises an orienting tube carrying the mounting fixture, said orienting tube being rotatably supported inside the gun carrier forming a rotatable assembly with the mounting fixture and the charges, and wherein the orienting tube is configured to provide stiffness to the rotatable assembly. By increasing the stiffness of the rotatable assembly containing the charges, the orientation of the charges can be improved, as the rotatable assembly will not sag or deflect and will not come in contact with the inside of the gun carrier. The mounting fixture can be fixed to the orienting tube creating a rotatable assembly comprising the mounting fixture, the charges, and the orienting tube where the charges rotate together with the orienting tube. The mounting fixture holding the perforating charges can be positioned at or close to the centerline of the orienting tube, or shifted out of center of the orienting tube, thereby offsetting the center of gravity of the orienting tube relative to its center axis. Offsetting the mounting fixture will influence the center of gravity of the rotatable assembly, and can be used as a means for orienting the charges inside the gun carrier. The orienting tube can be rotatably supported towards the interior of the gun carrier at each end and/or at one or more locations along the length of the orienting tube. An advantage with the increased stiffness of the rotatable assembly, due to the orienting tube, is that the number of rotatable supports may be reduced. The orienting tube can be configured to carry the load of the mounting fixture and the perforating charges, thus preventing sagging or deflection of the assembly.

The orienting tube may have small holes or spot faces in the wall opposite the charge outlets in order to minimize the wall thickness to be penetrated by the jet. The holes or spot faces may be arranged in a zig-zag pattern along the length of the orienting tube alternating around a single reference angle. This pattern can be used to accommodate situations where perforation in a zig-zag pattern is desirable, and thus the charges are placed accordingly. According to one embodiment of the invention, the holes or spot faces alternates between +10° and −10° relative to said reference angle. According to another embodiment, the holes or spot faces alternates between 0° and 180° relative to said reference angle.

The orienting tube can be oriented inside the gun carrier due to lateral offset center of gravity relative to its center axis, for example caused by weight balancing one or more of the perforating charges in the orienting tube and/or by adding separate weight elements in the mounting structure or orienting tube. The orienting tube may also be oriented by use of electric, magnetic or hydraulic positioning devices.

One of several advantages achieved is that the amount of debris may be reduced avoiding problems at a later stage when completion equipment is run and installed after perforation. Typical completion equipment may comprise complex items, including plugs, packers, hangers, polished bore interfaces, valves, etc. Setting interfacing with polished bores or packers in fluid with debris may be the source for damaged bore and interfacing surfaces, resulting in detrimental leaks etc. By eliminating or at least substantially reducing the presence of debris, such risk is eliminated or at least substantially reduced.

DESCRIPTION OF THE DIAGRAMS

Figure 1B:
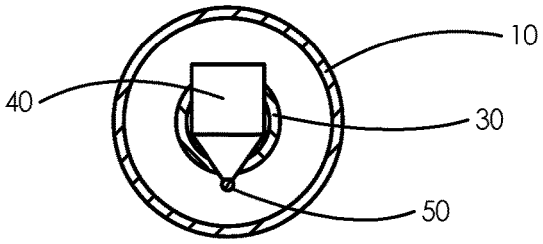
Figure 2A:
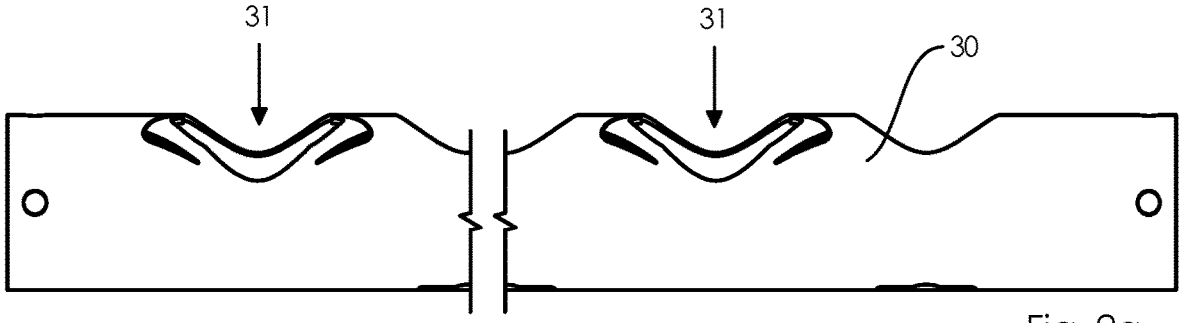
Figure 2B:
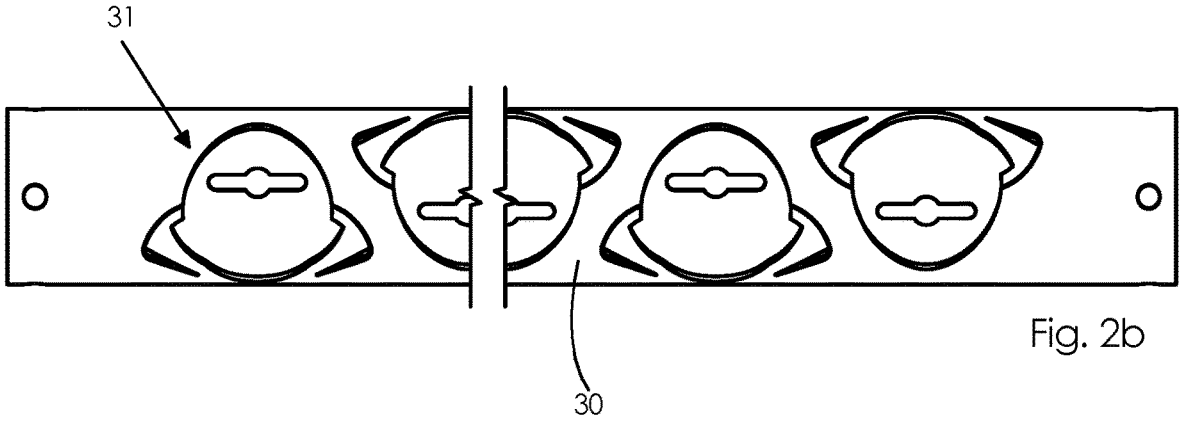
Figure 2C:
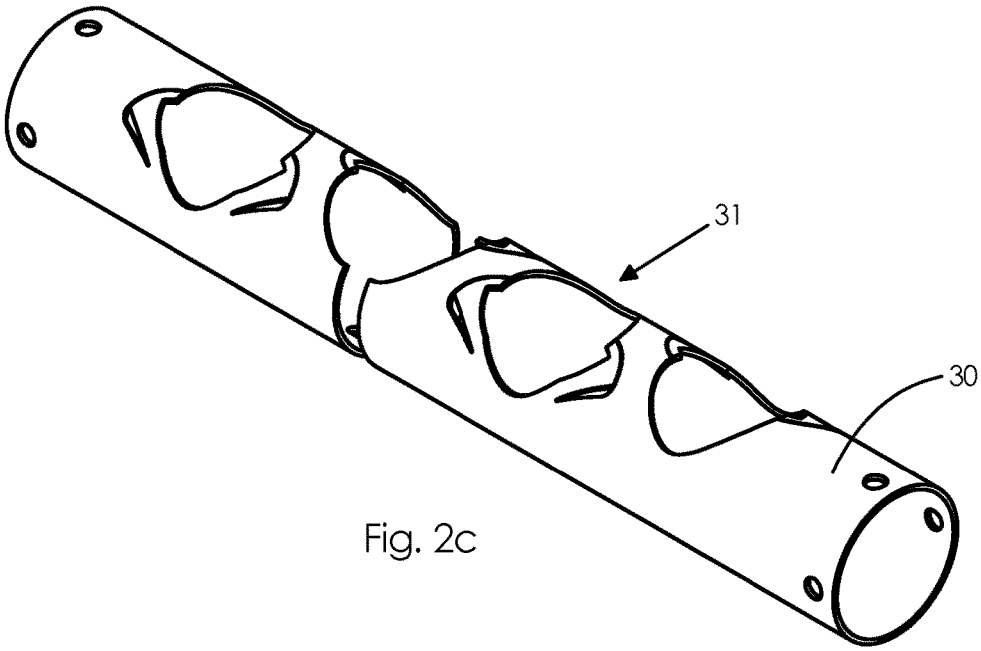
Figure 3A:
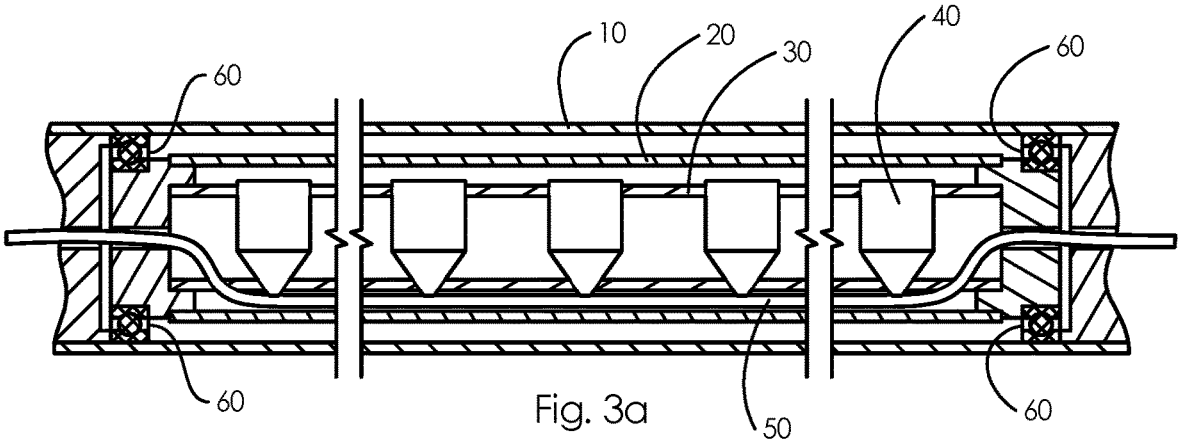
Figure 3B:
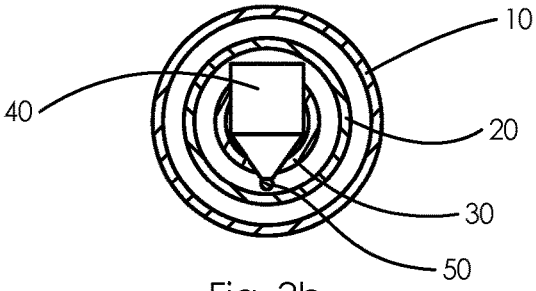
Figure 4A:
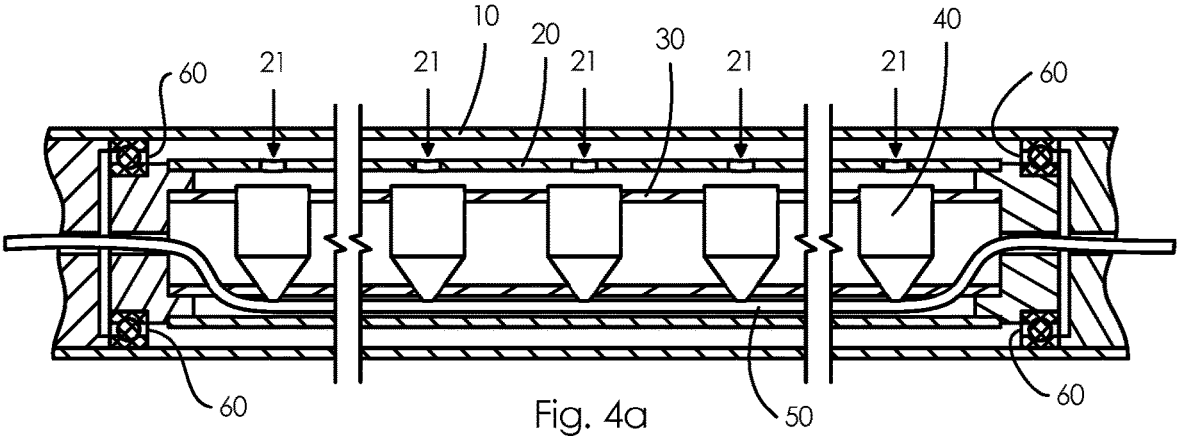
Figure 4B:
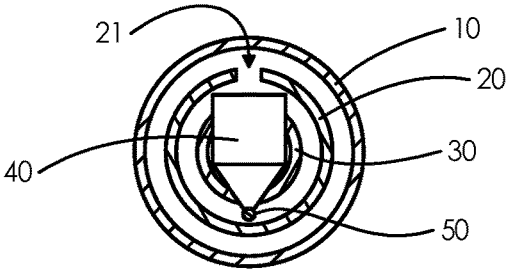
Figure 4C:
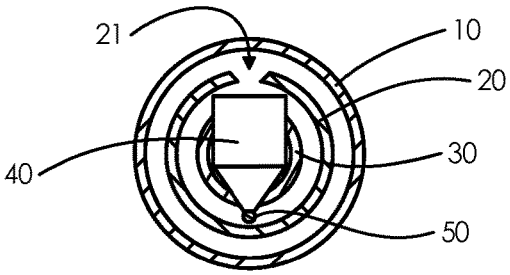
Figure 4D:
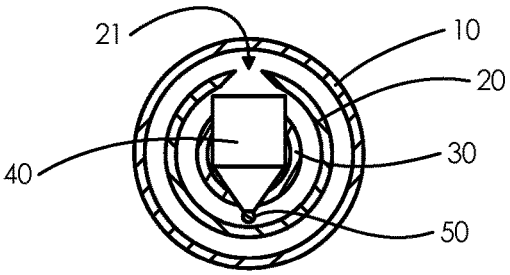
Figure 5A:
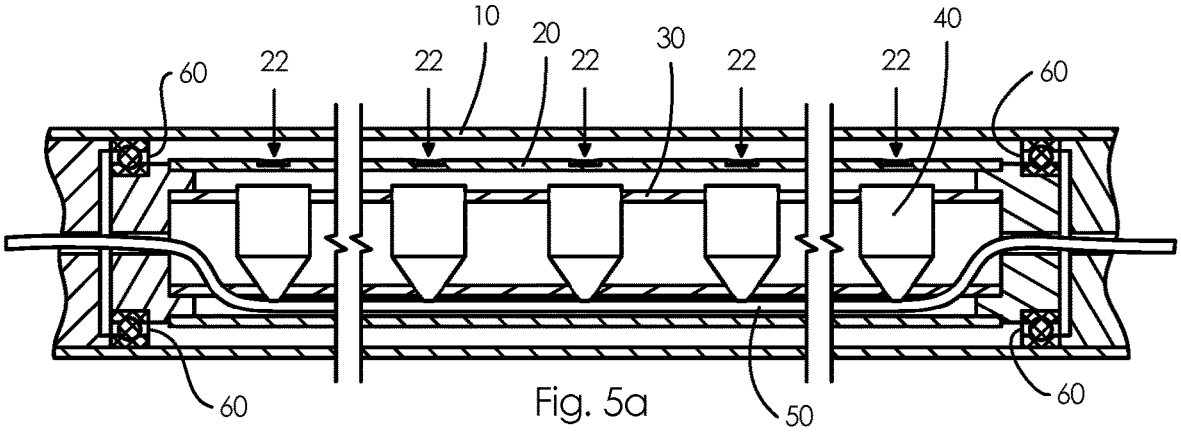
Figure 5B:
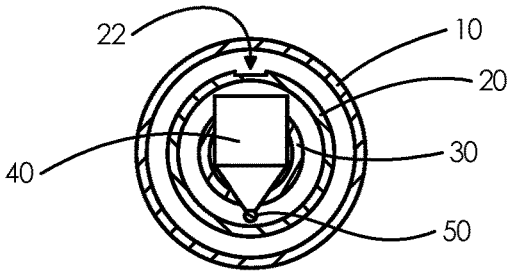
Figure 6A:
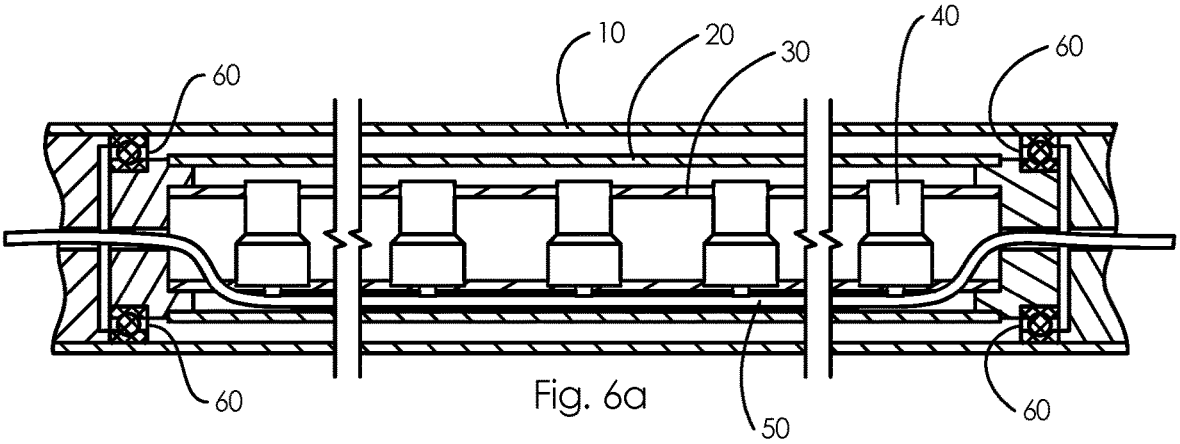
Figure 6B:
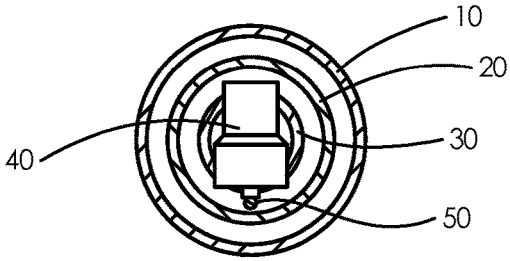
Figure 7A:
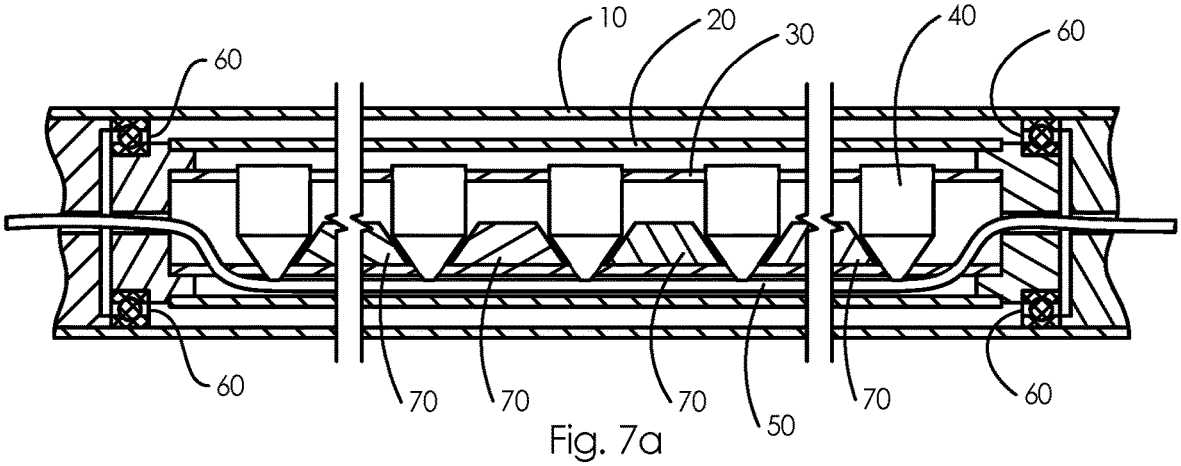
Figure 7B:
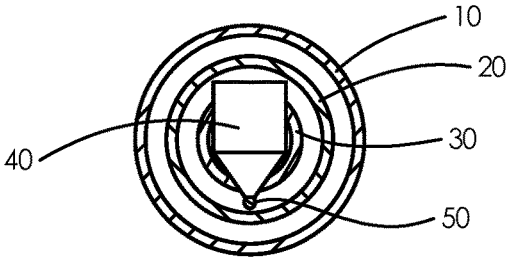
Figure 7C:
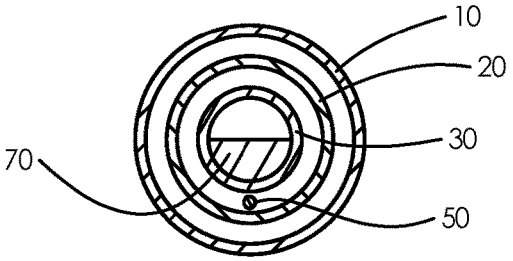
Figure 8A:
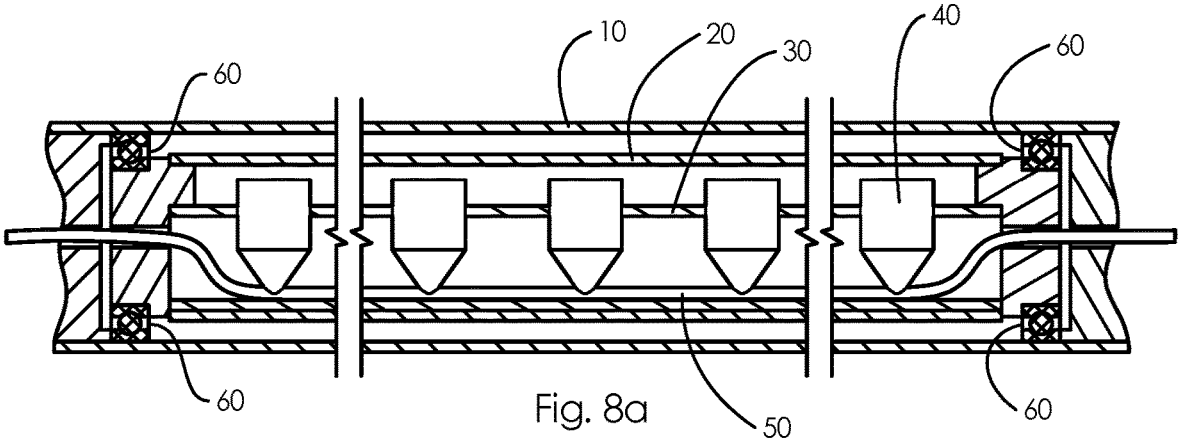
Figure 8B:
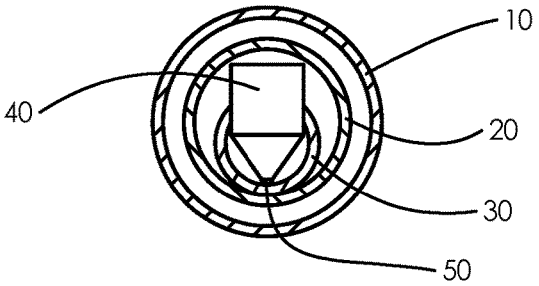
Figure 9A:
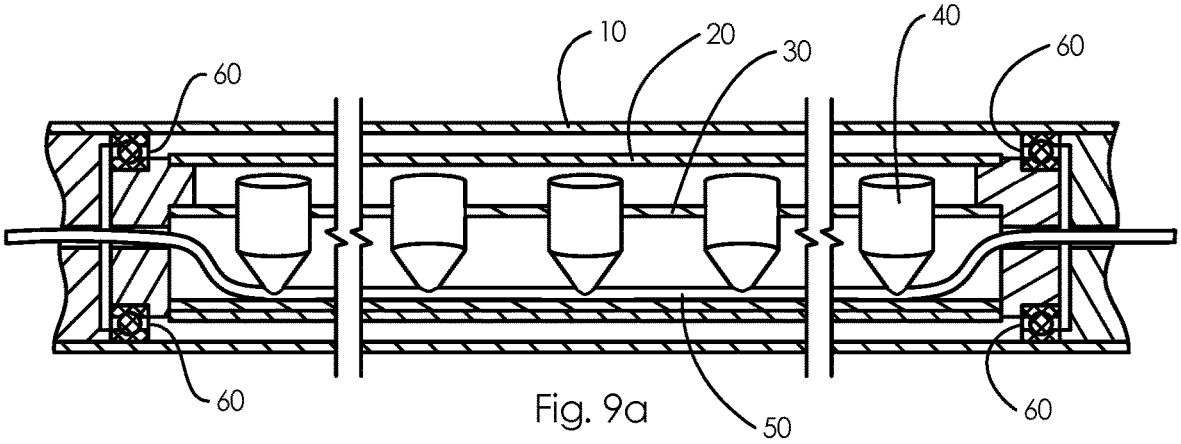
Figure 9B:
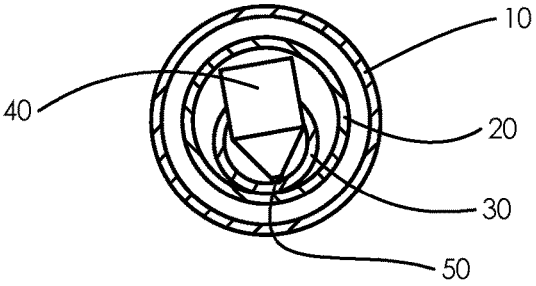
Figure 9C:
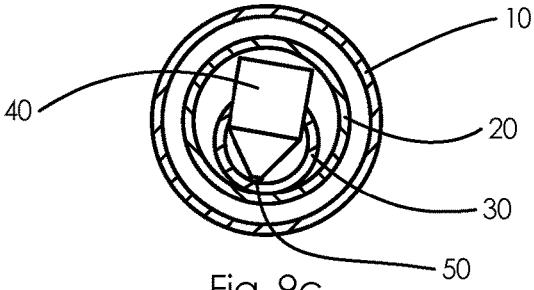

Embodiments of the present invention will now be described, by way of example only, with reference to the following diagrams wherein:

FIGS. 1*a* and 1*b* show schematically a typical internally oriented perforating gun from a longitudinal and transverse cross sectional view respectively;

FIGS. 2*a*, 2*b*, and 2*c*, show schematically and in three different views a typical loading tube with cut-outs for placement of charges;

FIGS. 3*a* and 3*b* show schematically a perforating gun with an orienting tube according to the invention in a longitudinal and transverse cross sectional view respectively;

FIGS. 4*a* and 4*b* show schematically a perforating gun according to the invention with holes in the orientating tube in a longitudinal and transverse cross sectional view respectively;

FIGS. 4*c* and 4*d* show schematically variants of hole designs in the orientating tube in a transverse cross sectional view;

FIGS. 5*a* and 5*b* show schematically a perforating gun according to the invention with spot faces in the orientating tube in a longitudinal and transverse cross sectional view respectively;

FIGS. 6*a* and 6*b* show schematically a perforating gun according to the invention with weighted charges in a longitudinal and transverse cross sectional view respectively;

FIGS. 7*a*, 7*b*, and 7*c*, show schematically a perforating gun according to the invention with weights added in longitudinal and transverse cross sectional views, FIGS. 8*a* and 8*b* show schematically a perforating gun according to the invention with eccentrically positioned mounting fixture in a longitudinal and transverse cross sectional view respectively; and FIGS. 9*a, b* and *c* show schematically a perforating gun according to the invention with charges positioned to shoot in directions +10° and −10° relative to vertical.

DESCRIPTION OF EMBODIMENTS DISCLOSED IN THE FIGURES

The following description of the exemplary embodiments refers to the accompanying drawings. The same reference numbers in different drawings identify the same or similar elements. The following detailed description does not limit the invention. Instead, the scope of the invention is defined by the appended claims. Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further particular features, structures or characteristics may be combined in any suitable manner or in one or more embodiments.

The present invention relates to a gun for perforating a casing, liner or tubing of a well, one of the main purposes of the invention being to create communication paths between the reservoir and the wellbore. This includes creating holes in the cement, formation rock and in the casing, liner or tubing in the well bore. The invention is not limited to a specific wellbore structure, and may be used for different types of wellbores with different types of casings or alternative support structures, where the purpose is to create fluid communication paths between the reservoir and the wellbore.

FIGS. 1*a* and 1*b* show schematically a longitudinal and a transverse cross-section of a typical internally oriented perforating gun where multiple charges 40 are mounted in a mounting fixture or loading tube 30 inside a gun carrier 10. The mounting fixture 30 is rotatably supported through rotational support structures 60 at each end towards the inside of the gun carrier 10. This allows the mounting fixture to rotate inside the gun carrier 10. A detonating cord 50 is laid along the outside of the mounting fixture at the tip of the charges where the primer charge is located. The detonating cord may also be placed inside the mounting fixture. If charges are positioned as shown in FIG. 1*a*, the jet will shoot upwards through the wall of the gun carrier and further through the wall of the liner, the cement and into the formation surrounding the liner. A typical problem with such guns, is that the loading tube 30 begins to sag between the supports 60, and thus the loading tube 30 and/or the charges 40 may come in contact with the inside wall of the gun carrier 10.

FIGS. 2*a, b*, and *c* show different views of a typical mounting fixture 30, cylindrical in shape, often called a "loading tube", with cut-outs 31 in the tube for mounting and holding in place the charges. These cut-outs 31 are typically circular holes large enough to fit the charges, and they have an opening on opposite end of the circular hole where the detonating cord 50 is located. Such cut-outs 31 cause a significant reduction in the stiffness of the loading tube 30 compared to a similar tube without cut-outs.

The length of the loading tube 30 can vary, depending, amongst others, on the length of the area to be perforated and on the number of charges 40. Due to the weight of the charges 40 and the loading tube 30 itself, the loading tube 30 may experience deflection, which can influence the reliability of the orientation of the charges 40 inside the perforating gun.

FIGS. 3*a* and 3*b* show schematically a longitudinal and a transverse cross section through an embodiment of a perforating gun according to the invention comprising an orienting tube 20. Multiple charges 40 are mounted in a mounting fixture 30 fixed inside the orienting tube 20. The orienting tube 20 is rotatably supported inside a gun carrier 10 through rotational support structures 60, forming a rotatable assembly comprising the mounting fixture 30 and the charges 40. The orienting tube 20 is configured to provide stiffness to the rotatable assembly. The orienting tube does not need large cut-outs or holes for placing the charges, and is thus stiffer than a typical loading tube. Material selection and geometry of the orienting tube can be selected in order to achieve the desired stiffness of the tube 20. The detonating cord 50 is, in this embodiment of the invention, placed in the space between the mounting fixture 30 and the inside of the orienting tube 20, but may in other embodiments of the invention be placed inside the mounting fixture 30. Main components of the gun, such as the charges 40, the mounting fixture 30, and the gun carrier 10 can be of conventional design. Since it is the orienting tube 20 that is rotated relative to the gun carrier 10 in order to orient the charges 40, the loading tube 30 may be allowed to sag or deflect to some extent, as this will not influence the rotation of the rotatable assembly. The loading tube 30 will in such case only come in contact with or bear against the orienting tube 20, which will prevent further deflection and ensure that the rotatable assembly is not in conflict with the inside of the gun carrier. In the embodiment of the invention shown in FIG. 3*a*, the rotational support structures 60 are located at each end of the orienting tube 20, however a perforating gun according to the invention can have rotational support structures 60 located anywhere along the length of the gun carrier 10 and the number of support structures 60 can vary depending on various factors, for example such as the length of the orienting tube 20 or the load carried by the orienting tube 20. In FIG. 3*a*, the charges 40 are all arranged in the same direction so that the jet will penetrate the gun carrier 10 at the top, however it is a purpose of this invention to allow the charges 40 to be positioned in any radial direction relative to the borehole axis, and each charge 40 may be positioned at a different angle than the adjacent charge 40, as will be shown later in FIGS. 9*a, b* and *c*. In FIG. 3*b*, the gun carrier 10, the orienting tube 20, and the mounting fixture 30 all have a circular profile and are concentric, however, according to the present invention, it is not a requirement that these elements are circular in shape nor that they are concentric. The invention is not limited to a specific type of mounting fixture 30, and a typical loading tube may be used.

The orienting tube 20 is larger in diameter than the radial extension of the mounting fixture 30 and it is a whole tube, without openings in the wall to fit the charges 40. This contributes to an increased stiffness of the structure compared to a typical loading tube. In addition, the orienting tube 20 will act as a barrier contributing to a reduction of the amount of debris escaping the gun after detonation, as the debris would have to travel through a hole in the orienting tube 20 and the gun carrier 10 in order to escape from the gun.

Suitable materials for the orienting tube could be various metal alloys or composite materials such as carbon fibre; however the invention is not limited to any specific materials. Materials with high strength and low weight are beneficial to avoid sagging of the orienting tube 20 between support structures 60.

FIGS. 4*a* and 4*b* show schematically a perforating gun according to the invention, where the orienting tube 20 has holes 21 in the wall opposite the charge outlets. These holes 21 are intended to allow the jet from the charges 40 to exit the orienting tube 20 without having to penetrate the wall of the orienting tube 20. The holes 21 can be large enough to allow the jet through the hole without any restriction, or smaller so that the jet needs to, at least partly, penetrate the wall of the orienting tube 20. The holes 21 may also have various shapes or designs for reasons such as to minimize jet restriction or minimize amount of debris exiting the holes 21, while still maintaining stiffness of the structure. For example, the holes 21 do not need to have a circular cross-section and the size of the holes may increase or decrease going from the inside to the outside of the wall of the orienting tube 20. The size and shape of the holes 21 may for example depend on the distance between the wall of the orienting tube 20 and the charge outlets and/or the type and amount of explosive material used. FIGS. 4*b*, 4*c*, and 4*d* shows three out of many possible hole designs as examples.

FIGS. 5*a* and 5*b* shows an element with similar purpose, however in this embodiment of the invention, the orienting tube 20 has spot faces 22 in the wall opposite the charges 40, to reduce the wall thickness that the jet needs to penetrate. Such spot faces 22 may vary in size, shape and depth, in order to weaken the wall at the location of the spot face 22 while ensuring minimum reduction of stiffness of the tube 20.

FIG. 6*a* shows an embodiment of the invention where the charges 40 are weight balanced for orientation of the charges 40 inside the gun carrier 10. The charges 40 are weight balanced and positioned in such a manner that gravity will rotate the rotatable assembly containing the charges 40, i.e. the assembly comprising the orienting tube 20, the mounting fixture 30, and the charges 40, and result in the charges oriented into a predetermined position. Weight biasing can also be used by having separate weights 70 installed on the rotatable assembly, as shown in FIGS. 7*a*, 7*b*, and 7*c*. In this embodiment of the invention, weights are placed between the charges 40 inside the mounting fixture 30 so that gravity will rotate the orienting tube 20 into a position where the perforation will act upwards. The weights do not need to be placed between each charge 40; they may for example be placed close to rotational support structures 60 to have as little weight as possible along the span of the orienting tube 20.

Another means for rotating the orienting tube 20 is shown in FIGS. 8*a* and 8*b*, where the mounting fixture 30 is placed eccentrically relative to the centre axis of the orienting tube 20. In this embodiment of the invention, the mounting fixture 30 is placed eccentrically in such a manner that it is in contact with the orienting tube 20 at a small section along the circumference, however it may be placed at a distance from the inside wall of the orienting tube 20. The principle is the same as for the embodiment where the charges are weight biased or where additional weight elements are added to the rotatable assembly; the rotatable assembly is weight biased and will rotate due to gravity inside the gun carrier. FIGS. 8*a* and 8*b* also show that the detonating cord 50 may be placed inside the loading tube 30, in contrast to previously shown embodiments of the invention, where the detonating cord 50 was placed inside the orienting tube 20. All of the above mentioned methods for using gravity to rotate the charges 40 can be used separately or in combination. Alternatively, or in addition to gravity, the invention may use electric, magnetic or hydraulic positioning devices to orient the charges into the desired position.

The charges 40 are often positioned to shoot in two directions alternating around one single direction; for example, alternating between 0° and 180° or between +10° and −10° relative to vertical. An example of this is shown in FIGS. 9*a, b* and *c*, where the charges are placed in positions alternating between +10° and −10° relative to vertical, in order to shoot the jet from the charges 40 in an upwards zig-zag pattern around the vertical centerline of the orienting tube 20.

The invention claimed is:

1. A gun for perforating a casing, liner or tubing of a well comprising multiple perforating charges in a mounting fixture, configured to rotate inside a gun carrier and orientate the charges to a predetermined direction relative to the casing, liner or tubing, wherein the gun also comprises a orienting tube carrying the mounting fixture, said orienting tube being rotatably supported inside the gun carrier forming a rotatable assembly with the mounting fixture and the charges, and wherein the orienting tube is configured to provide stiffness to the rotatable assembly.

2. The gun according to claim 1, wherein the mounting fixture is a loading tube fixed inside the orienting tube.

3. The gun according to claim 1 wherein the mounting fixture holding the perforating charges is fixed to the orienting tube.

4. The gun according to claim 1, wherein the mounting fixture is positioned at or close to the centerline of the orienting tube.

5. The gun according to claim 1, wherein the mounting fixture is shifted out of center of the orienting tube to obtain an offset center of gravity of the orienting tube relative to the center axis of the orienting tube.

6. The gun according to claim 1, wherein the orienting tube is rotatably supported towards the interior of the gun carrier at each end.

7. The gun according to claim 1, wherein the orienting tube is configured to carry the load of the mounting fixture and the perforating charges.

8. The gun according to claim 1, wherein the orienting tube comprises holes or spot faces in a wall opposite a plurality of charge outlets.

9. The gun according to claim 8, wherein the holes or spot faces in the orienting tube are positioned in a zig-zag pattern alternating around a single reference angle.

10. The gun according to claim 9, wherein the holes or spot faces alternates between +10° and −10° relative to said reference angle.

11. The gun according to claim 9, wherein the holes or spot faces alternates between 0° and 180° relative to said reference angle.

12. The gun according to claim 1, wherein the orienting tube is oriented inside the gun carrier due to lateral offset center of gravity relative to the center axis of the orienting tube due to weight balancing of one or more of the charges in the orienting tube.

13. The gun according to claim 1, wherein the orienting tube is oriented inside the gun carrier by use of electric or magnetic or hydraulic positioning devices.

14. The use of the gun according to claim 1, for perforating a casing, liner or tubing of a well.

15. The gun according to claim 1, wherein the orienting tube is rotatably supported at one or more locations along the length of the orienting tube.

16. The gun according to claim 1, wherein the orienting tube is oriented inside the gun carrier due to lateral offset center of gravity relative to the center axis of the orienting tube due to separate weight elements to the mounting fixture or orienting tube.

17. The gun according to claim 1, wherein the mounting fixture is fixed inside the orienting tube.

18. A method for orienting perforating charges inside a gun carrier of a perforating gun, comprising the steps of:

mounting the charges in a mounting fixture, arranging the mounting fixture, inside an orienting tube, forming a rotatable assembly comprising the orienting tube, the mounting fixture and the charges by rotatably supporting the orienting tube inside the gun carrier, wherein the orienting tube is configured to provide stiffness to the rotatable assembly, and rotating the orienting tube by use of weight biasing the rotatable assembly or by use of electric, magnetic, or hydraulic positioning devices.

19. The method according to claim 18, wherein the mounting fixture is fixed inside the orienting tube.

20. The method according to claim 18, wherein the mounting fixture is a loading tube fixed inside the orienting tube.

* * * * *